US008313090B2

(12) United States Patent
Kempf

(10) Patent No.: US 8,313,090 B2
(45) Date of Patent: Nov. 20, 2012

(54) MODULAR WINCH FOR STAGE USE

(75) Inventor: James Kempf, Wallkill, NY (US)

(73) Assignee: Production Resource Group, LLC, New Windsor, NY (US)

( * ) Notice: Subject to any disclaimer, the term of this patent is extended or adjusted under 35 U.S.C. 154(b) by 554 days.

(21) Appl. No.: 12/483,244

(22) Filed: Jun. 12, 2009

(65) Prior Publication Data

US 2009/0308826 A1 Dec. 17, 2009

Related U.S. Application Data

(60) Provisional application No. 61/061,403, filed on Jun. 13, 2008.

(51) Int. Cl.
*B66D 1/14* (2006.01)

(52) U.S. Cl. ..... 254/294; 254/380

(58) Field of Classification Search ..... 254/278, 254/283, 284, 285, 286, 290, 292, 294, 380
See application file for complete search history.

(56) References Cited

U.S. PATENT DOCUMENTS

| | | | | | |
|---|---|---|---|---|---|
| 3,687,249 | A * | 8/1972 | Priest et al. | ..... | 192/215 |
| 3,766,795 | A * | 10/1973 | Priest et al. | ..... | 74/405 |
| 5,374,035 | A * | 12/1994 | Santos | ..... | 254/339 |
| 5,678,805 | A * | 10/1997 | Moser et al. | ..... | 254/279 |
| 6,726,182 | B2 * | 4/2004 | Topping et al. | ..... | 254/376 |
| 7,097,157 | B1 * | 8/2006 | Lodrick | ..... | 254/362 |
| 7,128,307 | B2 * | 10/2006 | Dow | ..... | 254/342 |
| 7,364,136 | B2 * | 4/2008 | Hossler | ..... | 254/278 |
| 7,377,486 | B2 * | 5/2008 | Winter et al. | ..... | 254/380 |
| 7,478,795 | B2 * | 1/2009 | Grapes et al. | ..... | 254/333 |
| 7,543,800 | B2 * | 6/2009 | Grapes et al. | ..... | 254/376 |
| 7,766,308 | B2 * | 8/2010 | Kochan et al. | ..... | 254/394 |
| 7,850,146 | B2 * | 12/2010 | Kempf | ..... | 254/333 |
| 2005/0133770 | A1 * | 6/2005 | Dow | ..... | 254/218 |
| 2007/0075174 | A1 * | 4/2007 | Kohlenberg et al. | ..... | 242/397.2 |
| 2008/0048162 | A1 * | 2/2008 | Grapes et al. | ..... | 254/323 |
| 2008/0061277 | A1 * | 3/2008 | Grapes et al. | ..... | 254/352 |

* cited by examiner

*Primary Examiner* — Emmanuel M Marcelo
(74) *Attorney, Agent, or Firm* — Law Office of Scott C. Harris, Inc.

(57) ABSTRACT

A winch formed of modular components can be reconfigured between different operational configurations. A number of different lengths and devices can be attached to the winch.

10 Claims, 4 Drawing Sheets

MODULAR WINCH FOR STAGE USE

This application claims priority from provisional application No. 61/061,403, filed Jun. 13, 2008, the entire contents of which are herewith incorporated by reference.

BACKGROUND

Winches can be used to move various objects and scenery, especially in a stage environment.

SUMMARY

The present application describes a special winch which is reconfigurable or "modular"; making it capable of being configured as many different forms of winches.

An embodiment describes special parts that allow making connections and allows reconfigurability in this winch system.

DETAILED DESCRIPTION

An embodiment describes a modular winch formed from a power pack that is combined with a group of reconfigurable bulkheads/plates and connection systems between the power pack and bulkheads/plates. The winch is modular in that the group of parts can be attached together in multiple different ways that form different winch configurations. The system allows adding or subtracting components, and different components to be connected together in different ways.

Figure 1:
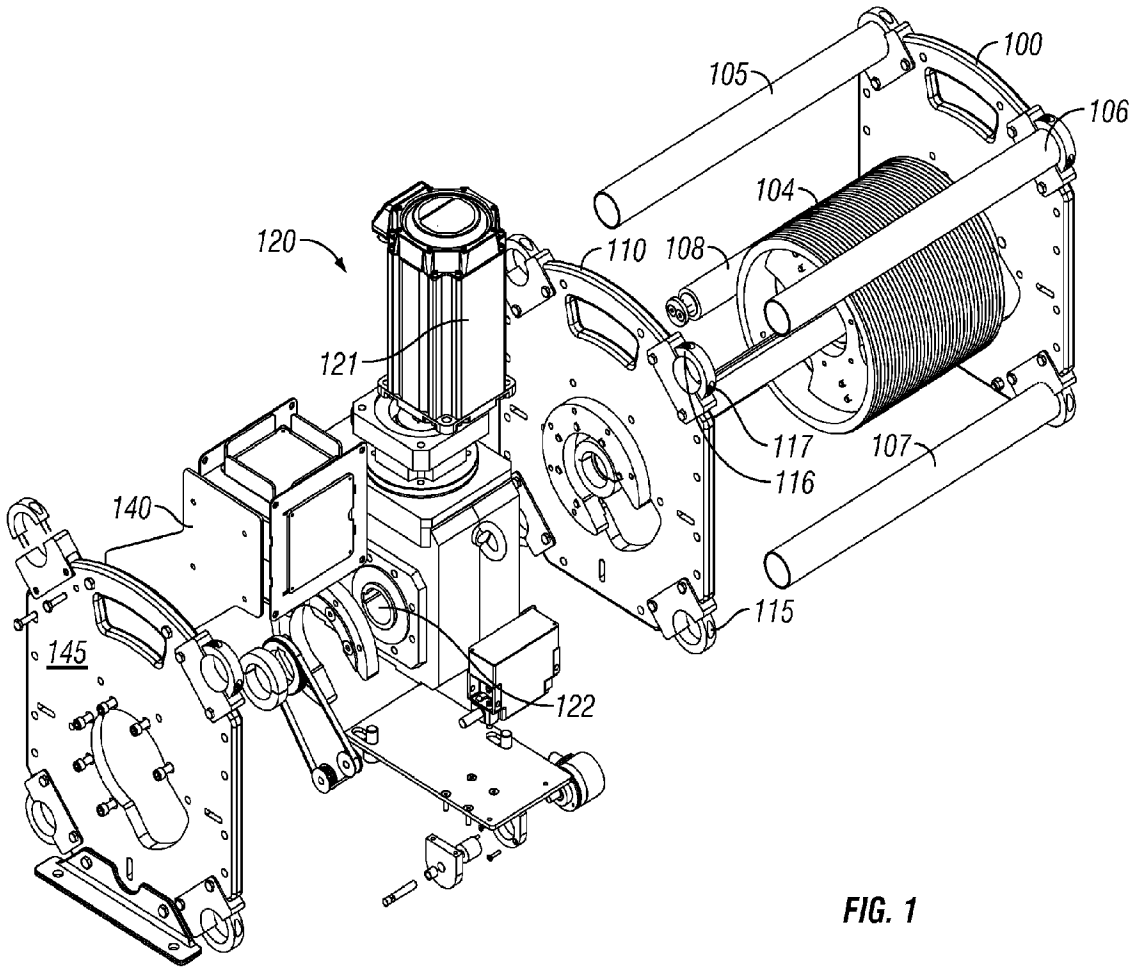
FIG. 1 shows an exploded view of parts which are put together to form the modular and reconfigurable winch.

A basic view of the parts making up the winch and one way in which they can be configured is shown in FIG. 1. The basic parts of the winch include a number of bulkheads such as 100, 110 connected by a number of support tubes such as 105, 106, 107 108, and one or more driving tube 119. Each of the tubes can be, for example, a 0.083 walled stainless steel tube; for example 22 inches long. While the embodiment describes these parts being connected by tubes, it should be understood that the parts can also be connected by structures of different outer shapes, such as squares, rectangles, hex shapes or others.

Each of the bulkheads such as 110 is formed with collar clamps 115 at each of the four edges of the bulkheads. Each of these collar clamps such as 115 has a set of adjustment screws 116, 117, that allow loosening and tightening the collar clamp. When in its loosest configuration, the outer surface of the rod 106 fits easily through the collar clamp 115. The rod can be inserted into the collar clamp, and the collar clamp 115 is tightened in order to press tightly against the rod 106.

Once tightened, the rod 106 holds and forms support between one area of two bulkheads.

The power pack is shown generally as 120, and includes a motor 121 with connections for an output shaft. Those connections can extend on both sides of the motor. The shaft may pass completely through the motor, and extend from one or both sides of the motor.

This shaft can also include locking collars at 122 (and on the opposite side, not seen in FIG. 1), that can lock onto the corresponding shaft 119. Thereafter, movement of the motor assembly 120 drives the shaft 119, and correspondingly drives anything attached to the motor assembly. For example, this may drive the winch take-up reel 104 to extend and retract the winch cable.

The other side of the winch can also connect to an additional structure shown as 140, using other bulkheads such as 145. The additional structure can be any desired device, as described herein. By attaching different devices between the motor and gearbox, different configurations become configurable using the same basic parts.

The shaft can be made of any desired length, to allow accommodating different numbers of devices. In one embodiment, drums may be located on both sides of the motor, making the motor and gearbox arranged as drum/motor gearbox/or to accommodate hauls of opposite edges of structures and where the two edges of the winch are spaced by different amounts.

Figure 2:
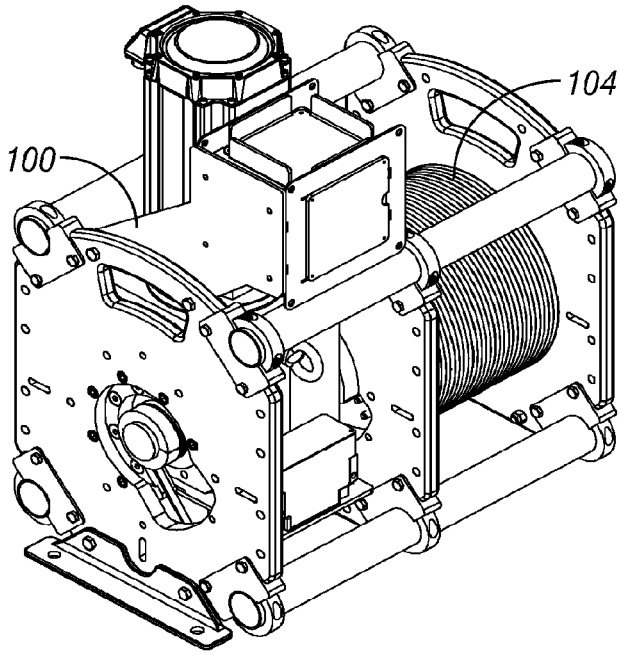
FIGS. 2-6 show the configurations of the winch using a common set of parts.

For example, FIG. 2 illustrates the standard setup, one power plant 120, one drum 104.

Figure 3:
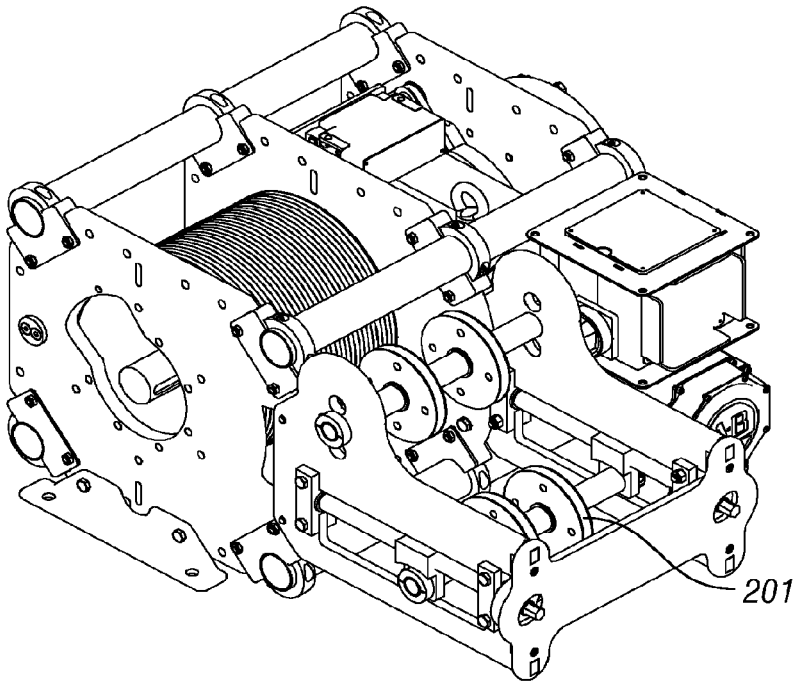

FIG. 3 shows the standard setup, also with a tensioner assembly 201 configured along with the one power plant, one drum.

Figure 4:
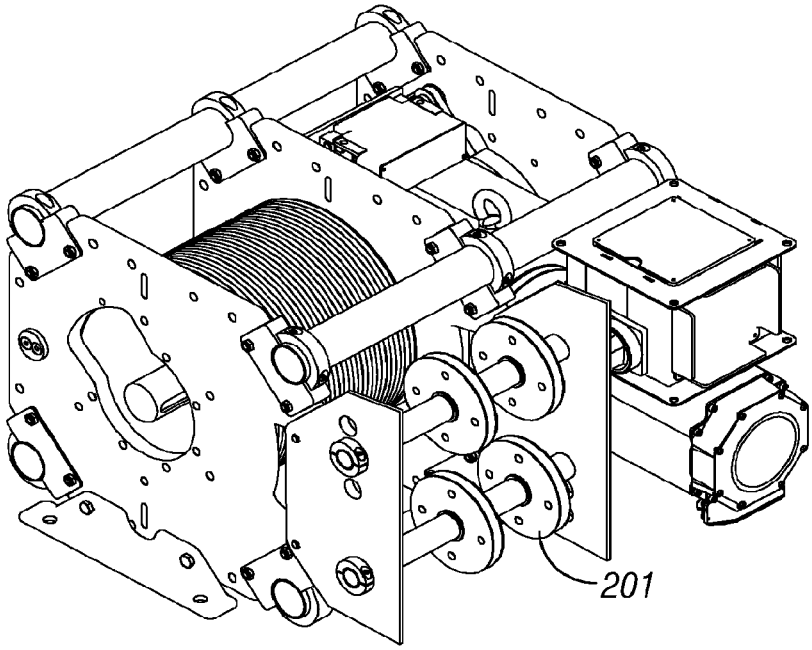

FIG. 4 shows the setup with outrigger sheaves 210.

Figure 5:
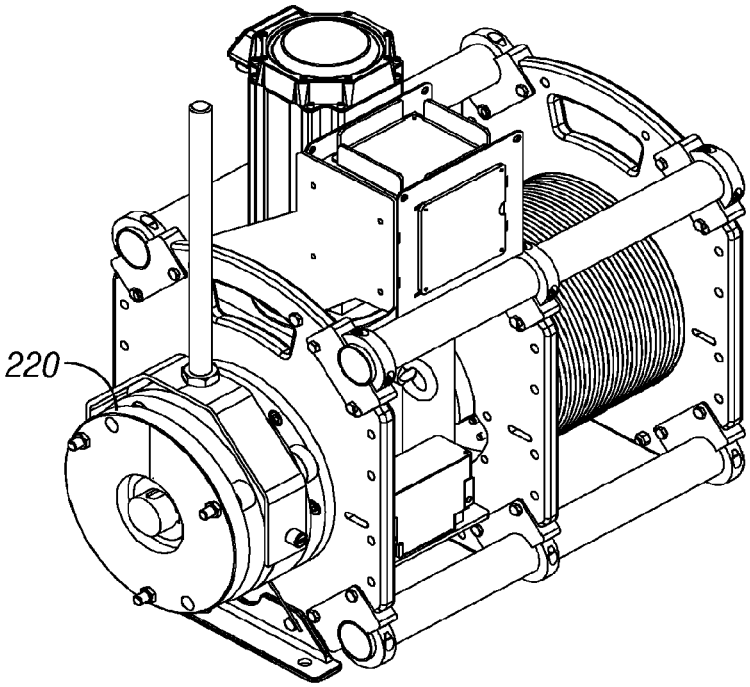

FIG. 5 shows a setup for movement of an actuator, with a safety brake 220 locked on the shaft 119. The brake 220 can be actuated to stop the motion of the winch.

Figure 6:
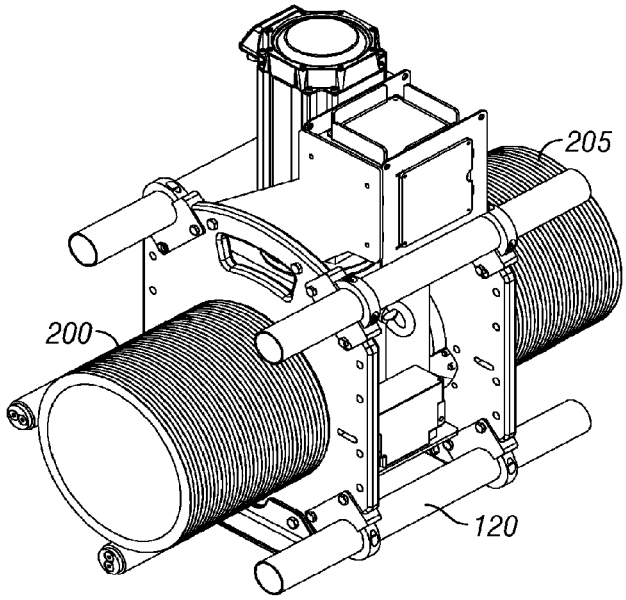

FIG. 6 shows a modular winch configured to have drums 200, 205 on both sides of the power plant 120, e.g., for a dead haul. While the assembly in FIG. 6 shows the drums as having closed outer surfaces, the shafts may extend all the way through the drums and out the other end. This thereby allows the shafts to extend through the drums, and to allow yet another drum or a brake or some other element to be attached thereto.

Any of these configuration or others can be used. In addition, by providing longer poles such as 106, 119, the winch can be changed to any desired length.

An important feature, is that the main power pack is limited only by the amount of power that can be provided. The devices can be 3 feet apart, or can be 30 feet apart, based solely on the length of the different poles.

Figure 7A:
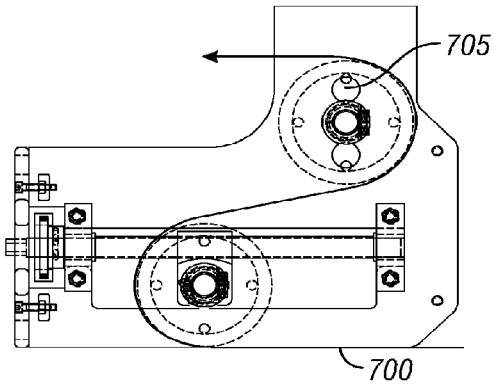
FIGS. 7A and 7B show the threading of cable in a follower.
Figure 7B:
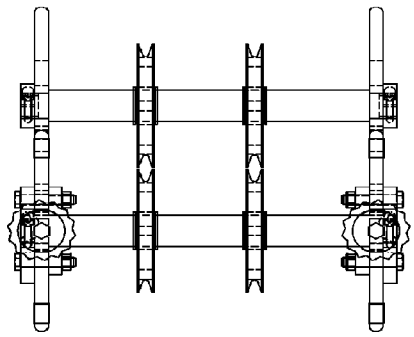

The tensioner sheave is shown in more detail in FIGS. 7A-7B. This system allows running a cable around the parts, thereby tensioning the soft loop of cable. This tensioner has "walking sheaves" that are on a shaft moving back and forth controlled by Acme screws by a drive. The sheaves move to tension the cable. As shown in FIG. 7A, the cable 700 goes over one roller, and under the other. More specifically, as shown, the cable 700 goes right around the lower sheave 710 from 6 to 12 o'clock clockwise across to and around the upper sheave 705 from 6 to 12 o'clock counter-clockwise and straight out to the upper left. The "bottom" roller/sheave 710 moves back and forth to adjust the tension.

The system can have two cables—one going on; the other going off, at the same time.

The Winch is Made with the Following Dimensional Goals—

Length: 22.25"
Width: 16.25"
Height: 28"
Weight: 300 lbs basic unit
Operating Parameter Targets (29.2:1 Gearbox)—
Max load speed: 5.5 fps
Max line pull: 656 lbs
Max load travel: 83'
Operating Parameter Targets (58.3:1 Gearbox)—
Max load speed: 2.8 fps Max line pull: 1309 lbs (on dual ¼" cables)
Max load travel: 83'
Examples of Winch Applications—
Driving deck tracks
Driving heavy duty counterweight assist line sets
Driving heavy duty traveler tracks
Dead hauling scenic units or actors with secondary brake (s) mounted.
Examples of Various Winch Configurations—
Power pack with 29:1 gearbox, one drum: deck winch
Power pack with 29:1 gearbox, one drum, outriggers: deck winch with walking sheaves
Power pack with 29:1 gearbox, one drum, tensioner: deck winch with tensioning (standard)
Power pack with 29:1 gearbox, dual drums: deck winch for tandem tracks
Power pack with 29:1 gearbox, one drum, one brake: dead haul pick winch (actor fly)
Power pack with 29:1 gearbox, dual drums, one brake: dead haul ladder winch
Power pack with 29:1 gearbox, dual sprockets, one brake: high speed low load trap lift winch
Power pack with 29:1 gearbox, multi drums, multi brakes: fast lineshaft winch in truss
Power pack with 58:1 gearbox, dual drums, dual outriggers: high strength tandem tracks
Power pack with 58:1 gearbox, dual drums, dual brakes: heavy ladder dead haul winch
Power pack with 58:1 gearbox, dual sprockets, dual brakes: low speed high load trap lift winch
Power pack with 58:1 gearbox, multi drums, multi brakes: slow lineshaft winch in truss
Winch mounting can be carried out in the following way.
The modular winch can mount above/below/beside a surface with the modular steel angle brackets.
The modular winch can mount above/below/beside a surface or truss with 2" pipe clamps.
The modular winch can mount inside 20.5" Tomcat truss with 2" pipe clamps.
Note: the modular winch can mount with motor either vertical or horizontal.
Winch Shipping and Handling—
When not permanently mounted to a truss, up to 6 winches can be strapped/shrink wrapped together on a standard wood pallet.
List of Purchased Mechanical Parts (Fastening Hardware not Included)—
Motor—Allen Bradley MPL-A540k
Gearbox—Stober K513 29.2:1 or 58.3:1
Drum hub—Martin 60K27 (modified)
Optional secondary brake—Mayr Roba-stop 500
Limit box—Cutler Hammer 103:1
Secondary encoder—Sick Stegman ATM60
Limit box driver—Martin 48XL037 50 mm bore KWSS
Limit box Driven—Martin XL037 12 mm bore KWSS
Encoder driven—Martin XL037 ⅜" bore DSS
Encoder coupling—MMC ⅜" to ⅜" Rigid
Feedback belt—Gates 220XL037
Shaft collar—MMC 50 mm split
Bearing—SKF 6010-2SR1
List of CNC Cut and then Machined Aluminum Parts—
¾" Main plate
¼" IJ box plate
1" bearing plate
⅝" walking sheave blank
1" drum center plate
½" tensioner side plate
½" outrigger side plate
¼" limit base
⅜" cable clamps (no machining)
½" encoder plate A
½" encoder plate B
List of CNC Cut and then Machined Steel Parts—
1" corner brackets
1" gearbox pilot
List of Machined Only Parts—
Bronze walking sheave bushings
Steel tensioner screw mount
Steel tensioner shuttle
1.75" delrin keeper rollers
1.25" steel keeper shafts
14 mm×9 mm key
⅜" CR steel encoder shaft extension
50 mm main shaft
⅞-6 acme tensioner screws
1.25 steel outrigger shafts
Target Winch Speed Calculation (29.2:1 Gearbox)—
3400 rpm motor speed divided by 29.2:1 gearbox equals 116 rpm shaft speed multiplied by a 34.2" drum circumference per revolution equals 3967 inches per minute divided by 12" inches per foot and 60 second per minute equals a line speed of roughly 5.5 feet per second.
Target Winch Line Pull Calculation (29.2:1 Gearbox)—
A 130 inlb motor into a 29.2:1 gearbox produces 3796 inlbs of torque multiplied by 94% gearbox efficiency equals 3568 inlbs at the drum shaft. The 3568 inlbs divided by a drum radius of 5.44" yields 656 lbs of line pull.
Target Winch Speed Calculation (58.3:1 Gearbox)—
3400 rpm motor speed divided by 58.3:1 gearbox equals 53 rpm shaft speed multiplied by a 34.2" drum circumference per revolution equals 1995 inches per minute divided by 12" inches per foot and 60 second per minute equals a line speed of roughly 2.8 feet per second.
Target Winch Line Pull Calculation (58.3:1 Gearbox)—
A 130 inlbs motor into a 58.3:1 gearbox produces 7579 inlbs of torque multiplied by 94% gearbox efficiency equals 7124 inlbs at the drum shaft. The 7124 inlbs divided by a drum radius of 5.44" yields 1309 lbs of line pull.
Target Winch Travel Calculation—
A 10.88" diameter drum 10" wide with 0.281" lead for ¼" cable has roughly 35 complete wraps minus 6 safety wraps equals 29 active wraps multiplied by 34.2 inches per wrap equals 991 inches divided by 12 inches per foot equals 83' max load travel.

Although only a few embodiments have been disclosed in detail above, other embodiments are possible and the inventors intend these to be encompassed within this specification. The specification describes specific examples to accomplish a more general goal that may be accomplished in another way. This disclosure is intended to be exemplary, and the claims are intended to cover any modification or alternative which might be predictable to a person having ordinary skill in the art. For example, other sizes and parts can be used.

What is claimed is:

1. A modular winch assembly comprising:

a power device, having a connection to a driving shaft, said power device having a first driving shaft of a first length, and a second driving shaft of a second length, wherein said power device can only accommodate one of said first and second driving shafts at any time, and one of said first and second driving shafts extend through said power device at said any time and provide rotation force from said power device on both first and second sides of said power device.

2. An assembly as in claim 1, wherein said modular winch assembly further includes a plurality of bulkheads, each bulkhead having a number of openings, and said driving shaft extending through one of said openings.

3. An assembly as in claim 1, wherein said winch assembly includes a drum on one side of said power device, and an electronic brake on the other side of said power device.

4. An assembly as in claim 1, further comprising a plurality of sheaves, which automatically tension a cable connected thereto.

5. An assembly as in claim 1, wherein said winch assembly includes drums on first and second sides of said power device.

6. An assembly as in claim 1, wherein said power device is a motor, and further comprising first and second devices on said first and second sides of said motor, where said first device faces a first side of said motor, and said second device faces an opposite second side of said motor, on the opposite side of said motor from said first side.

7. An assembly as in claim 1, further comprising first and second bulkheads and first and second connection bars for said bulkheads, where said first and second bulkheads are spaced by a first distance when said first driving shaft of said first length is connected and are spaced by a second distance when said second driving shaft of said second length is connected.

8. A modular winch assembly comprising:

a power device, having a connection to a driving shaft, said power device having a first driving shaft of a first length, and a second driving shaft of a second length, wherein said power device can only accommodate one of said first and second driving shafts at any time, and one of said first and second driving shafts extend through said power device at said any time and provide rotation force from said power device on both first and second sides of said power device, wherein said modular winch assembly further includes a plurality of bulkheads, each bulkhead having a number of openings, and said driving shaft extending through one of said openings, wherein each of said bulkheads also includes a split collar plate at an edge portion thereof, said split collar plate having a first position which positions to allow a shaft to be inserted therein, and said split collar plate having a tightened position which holds said shaft therein.

9. An assembly as in claim 8, wherein said split collar plate is at one of four outer corners of said bulkheads, and further comprising three other split collar plates, at remaining outer corners of said bulkheads, such that one of said split collar plates is at each of four outer corners of the bulkhead.

10. An assembly as in claim 9, further comprising another bulkhead, and plural shafts, extending between said bulkhead and said another bulkhead at each of said four corners, said shafts holding said bulkhead and said another bulkhead spaced from one another.

* * * * *